US008152702B2

(12) United States Patent
Pacheco

(10) Patent No.: US 8,152,702 B2
(45) Date of Patent: Apr. 10, 2012

(54) EXERCISE APPARATUS, RESISTANCE SELECTOR FOR EXERCISE APPARATUS AND RELATED METHODS

(75) Inventor: Chad R. Pacheco, Colorado Springs, CO (US)

(73) Assignee: Icon Health & Fitness, Inc., Logan, UT (US)

( * ) Notice: Subject to any disclaimer, the term of this patent is extended or adjusted under 35 U.S.C. 154(b) by 314 days.

(21) Appl. No.: 12/042,880

(22) Filed: Mar. 5, 2008

(65) Prior Publication Data

US 2009/0227432 A1 Sep. 10, 2009

(51) Int. Cl.
*A63B 21/062* (2006.01)

(52) U.S. Cl. ..... 482/103; 482/98

(58) Field of Classification Search ..... 482/92–104, 482/107, 135–138; D21/675, 680
See application file for complete search history.

(56) References Cited

U.S. PATENT DOCUMENTS

| | | | | |
|---|---|---|---|---|
| 4,606,540 | A * | 8/1986 | Chin-Sen | 482/98 |
| 4,610,449 | A | 9/1986 | Diercks, Jr. | |
| 4,627,615 | A * | 12/1986 | Nurkowski | 482/98 |
| 4,809,973 | A | 3/1989 | Johns | |
| 5,000,446 | A | 3/1991 | Sarno | |
| 5,306,221 | A * | 4/1994 | Itaru | 482/98 |
| 5,350,344 | A | 9/1994 | Kissel | |
| 5,556,362 | A | 9/1996 | Whipps | |
| 6,117,049 | A | 9/2000 | Lowe | |
| 6,174,265 | B1 | 1/2001 | Alessandri | |
| 6,186,927 | B1 | 2/2001 | Krull | |
| 6,468,189 | B2 | 10/2002 | Alessandri | |
| 6,582,345 | B2 | 6/2003 | Roy | |
| 6,719,672 | B1 * | 4/2004 | Ellis et al. | 482/99 |
| 7,413,532 | B1 * | 8/2008 | Monsrud et al. | 482/99 |
| 7,473,211 | B2 * | 1/2009 | Lee | 482/97 |
| 7,608,021 | B1 * | 10/2009 | Nalley | 482/98 |
| 7,614,981 | B2 * | 11/2009 | Cao | 482/98 |
| 7,708,672 | B2 * | 5/2010 | Gibson et al. | 482/98 |
| 2002/0049123 | A1 * | 4/2002 | Krull | 482/98 |
| 2002/0119870 | A1 * | 8/2002 | Chen | 482/93 |
| 2003/0092542 | A1 * | 5/2003 | Bartholomew et al. | 482/99 |
| 2003/0153439 | A1 | 8/2003 | Krull | |
| 2005/0143228 | A1 * | 6/2005 | Lee | 482/94 |
| 2006/0217245 | A1 * | 9/2006 | Golesh et al. | 482/94 |
| 2007/0072748 | A1 * | 3/2007 | Lee | 482/93 |
| 2007/0203001 | A1 * | 8/2007 | Krull | 482/94 |
| 2008/0015094 | A1 * | 1/2008 | Casagrande | 482/100 |
| 2008/0242520 | A1 * | 10/2008 | Hubbard | 482/98 |

FOREIGN PATENT DOCUMENTS

| | | | |
|---|---|---|---|
| FR | 2613237 | A1 * | 10/1988 |
| WO | 88/06909 | A1 | 9/1988 |
| WO | 2007/011433 | A2 | 1/2007 |

* cited by examiner

*Primary Examiner* — Loan Thanh
*Assistant Examiner* — Daniel Roland
(74) *Attorney, Agent, or Firm* — Holland & Hart LLP

(57) ABSTRACT

Apparatuses having selective having selective resistance, related mechanisms and devices, and methods to operating exercise equipment are provided. In one embodiment, the exercise apparatus includes a frame and at least one guide member coupled with a portion of the frame. A weight stack, including a plurality of weight plates, is associated with the at least one guide member. The exercise apparatus also includes a resistance selector having at least one rail coupled to an uppermost weight plate of the plurality of weight plates. A body is slidably coupled to the at least one rail. A pin is slidably coupled to the body and configured to be displaced between at least a first position and a second position relative to the body. An engagement structure is coupled with the pin and configured to selectively engage at least one abutment shoulder of at least one weight plate of the plurality of weight plates.

16 Claims, 9 Drawing Sheets

EXERCISE APPARATUS, RESISTANCE SELECTOR FOR EXERCISE APPARATUS AND RELATED METHODS

TECHNICAL FIELD

The present invention relates generally to exercise equipment and, more particularly, to exercise equipment having selectable resistance, components for effecting the selection of a desired amount of resistance and related methods.

BACKGROUND

There are numerous types of apparatuses and devices that are configured to help individuals exercise and maintain a desired level of health and fitness. Some of such apparatuses and devices are more specifically used for strength training. Many strength training apparatuses are configured to provide selective resistance so that a user of the apparatus may appropriately alter and tailor their exercise regimen. For example, when the apparatus is used by multiple users, each individual using the apparatus may be at a different strength level and need to adjust the resistance according to their specific capabilities. Also, as an individual gets stronger, they often desire to increase the resistance provided by the apparatus so as to maintain or increase the intensity of their workout.

Additionally, many strength training apparatuses are configured to accommodate different types of exercises so that a user can target different muscle groups based on the selection of exercises the user participates in. For example, a strength training apparatus may enable an individual to alternate between presses, curls, pull-downs, or a variety of other exercises while using the same basic resistance mechanism. In order to accommodate such a variety of exercises, the resistance mechanism is typically configured to provide selective resistance because most users do not perform, for example, presses, curls and pull downs using the same amount of resistance for each exercise.

A relatively popular type of apparatus used for strength training includes those which employ a plurality of stacked weight plates. Each weight plate conventionally weighs a specified denomination (e.g., 5 pounds or 10 pounds). Thus, for example, assuming that each weight plate is 10 pounds, selection of a single weight plate results in a resistance of 10 pounds, while selection of 4 weight plates results in a resistance of 40 pounds.

In these exercise devices, a cable is led through a pulley, or often a series of pulleys, and is attached to one or more of the weight plates. Conventionally, the free end of the cable is coupled to a handle or other apparatus for engagement by a user during exercise. The pulley and cable assembly is also coupled with a structure, such as a selector rod associated with the weight stack, that enables the user to define the level of desired resistance. The selector rod conventionally passes through a channel that is collectively defined by aligned apertures formed in each of the plurality of stacked weight plates. The selector rod also conventionally has a plurality of longitudinally spaced apertures extending transversely through the rod that are configured to align with corresponding channels or openings formed in each weight plate. A selector pin is placed through a selected weight plate and engages the corresponding aperture of the selector rod such that, when the selector rod is displaced by the attached cable and pulley system, the selector pin causes the engaged weight plate, as well as any weight plates disposed thereabove, to be displaced along with the selector rod. Thus, by inserting the selector pin in the aperture of a specific weight plate, the desired level of resistance is selected.

The use of selector pins with weight stacks of an exercise apparatus has been relatively efficient and effective in terms of enabling multiple users to use the same machine as well as enabling individual users to use a single machine for a variety of different exercises. In certain situations, however, the use of a selector pin such as described above may pose a hazard to the user of the exercise apparatus. For example, sometimes a user of the apparatus may only partially engage the selector pin with the selector rod. In such instances, the selector pin may become disengaged during an exercise routine causing the weight plates to fall and essentially eliminating all resistance instantaneously. Such a situation may potentially result in injury to the user of the equipment, damage to the equipment itself, or both. In other instances, when the selector pin is only partially engaged, it may unduly protrude from the weight stack such that it impacts a portion of the exercise equipment (e.g., a structural support member) and bends or otherwise damages the selector pin.

Additionally, strength training apparatuses using weight stacks and selector pin arrangements are popular in gyms and fitness centers where multiple types and multiple brands of such strength training apparatuses are used. Oftentimes, the selector pins used in these various apparatuses get lost, essentially rendering the exercise equipment useless. When a selector pin for one piece of equipment is missing, a user may "borrow" a selector pin from another apparatus. However, not every exercise apparatus utilizes a common selector pin. Thus, selector pins may vary in size, shape and strength from one apparatus to another. While, to a user of the exercise equipment, it may seem logical to "borrow" a selector pin from one apparatus for use with another, the use of a selector pin that is an improper size or shape, or which may be designed to withstand a lesser exertion of force than will be imposed on it when employed with an unmatched apparatus, poses potential hazards including those described above.

The present invention, as described below, provides an exercise apparatus having a resistance selector mechanism that reduces or eliminates the ability of users to interchange components of one machine with another. Additionally, components are provided that reduce or eliminate the likelihood of interchanging components of one exercise apparatus with another in an undesirable manner. Further, a selector mechanism is provided that helps to ensure that a selector pin or structure is more fully engaged with the desired components prior to a user operating the associated exercise apparatus.

BRIEF SUMMARY OF THE INVENTION

The present invention provides exercise apparatuses having selective resistance, mechanisms and devices for selecting resistance on an exercise apparatus, and methods to operating exercise equipment.

In accordance with one embodiment of the present invention and exercise apparatus is provided. The exercise apparatus includes a frame and at least one guide member coupled with a portion of the frame. A weight stack, including a plurality of weight plates, is associated with the at least one guide member. The exercise apparatus also includes a resistance selector. The resistance selector includes at least one rail coupled to an uppermost weight plate of the plurality of weight plates. A body is slidably coupled to the at least one rail. A pin is slidably coupled to the body and configured to be displaced between at least a first position and a second position relative to the body. An engagement structure is coupled with the pin and configured to selectively engage at least one abutment shoulder of at least one weight plate of the plurality of weight plates.

In accordance with another embodiment of the present invention, a resistance selector for selectively engaging a desired component of an exercise apparatus is provided. The resistance selector includes at least one rail having a plurality of teeth and a plurality of notches. a body slidably coupled to the at least one rail. A pin is slidably coupled to the body and configured to be displaced between at least a first position and a second position relative to the body. An engagement structure is coupled with the pin and configured to selectively engage the plurality of notches.

In accordance with another embodiment of the invention, a weight plate for use with an exercise apparatus is provided. The weight plate includes a body having a first surface, a second, opposing surface and a peripheral surface, the peripheral surface defining, at least in part, a substantially T-shaped opening. The weight plate may further comprises at least one abutment shoulder formed in a portion of the substantially T-shaped opening. Additionally, the abutment shoulder may include a surface that is not coplanar with either the first surface or the second, opposing surface.

In accordance with yet another embodiment of the present invention, a method is provided of operating an exercise apparatus. The method includes coupling a resistance selector with a weight stack of the exercise apparatus, the weight stack having a plurality of weight plates associated with at least one guide member. A body of the resistance selector is displaced along a path defined by a slot in at least one rail of the resistance selector. A pin is displaced relative to the body of the resistance selector and an abutment shoulder formed in an opening of a first weight plate of the plurality of weight plates is engaged with an engagement structure that is coupled to the pin. The at least one weight plate and the resistance selector are concurrently displaced.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
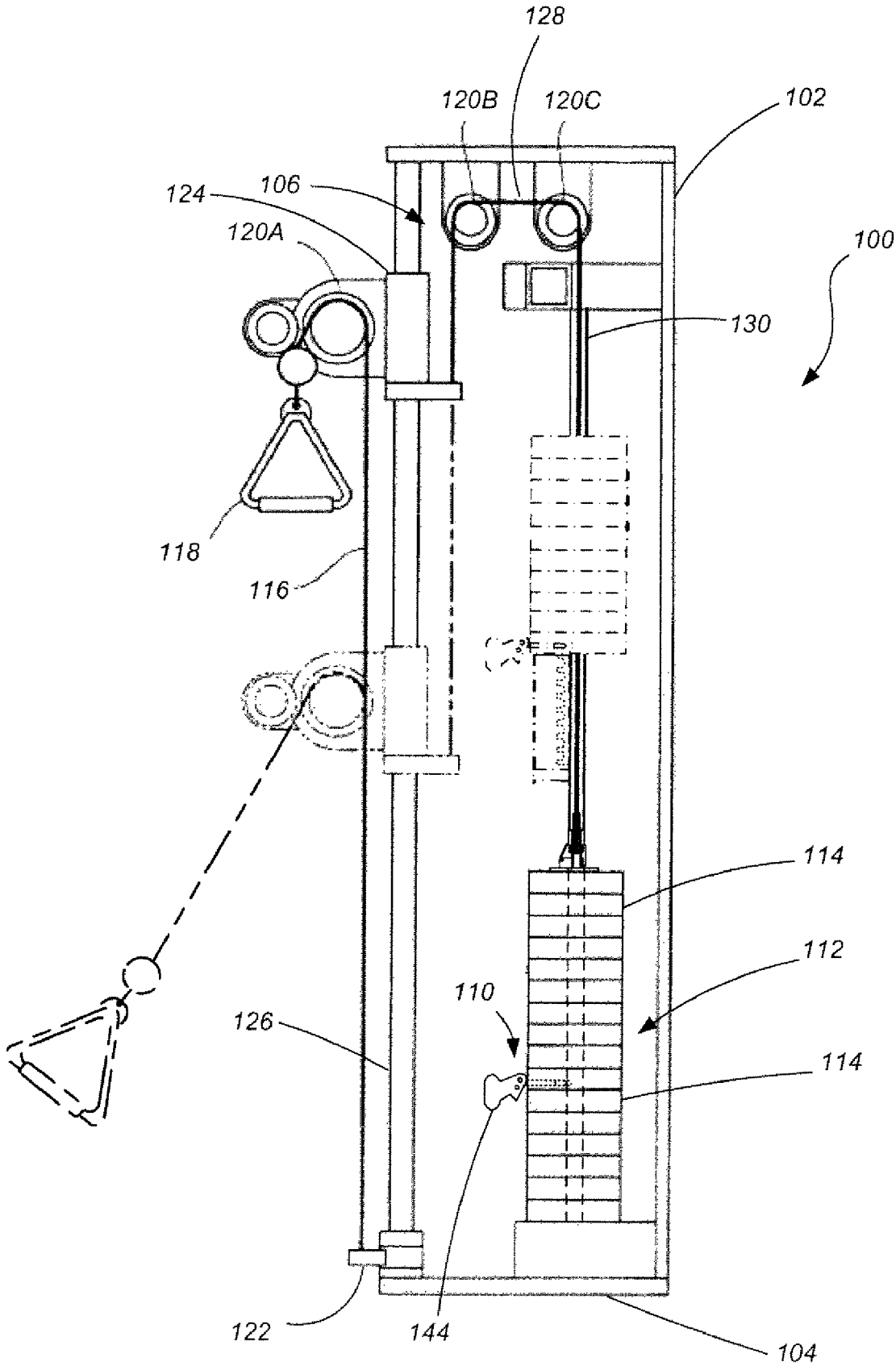
FIG. 1 is side elevational view of an exercise apparatus according to one embodiment of the present invention.

Referring to FIG. 1, an exercise apparatus 100 is shown that includes a frame 102 having a base 104 configured to support the apparatus 100 on an underlying surface. A cable and pulley system 106 is coupled with the frame. In one embodiment, the cable and pulley system 106 may be operably associated with a resistance selector 110. The resistance selector 110 is configured to be selectively coupled with one or more components of a variable, selective resistance system which may include a weight stack 112 as shall be discussed in further detail hereinbelow. The weight stack 112 may include a plurality of individual weight members, such as plates 114, having a desired mass. For example, in one embodiment, each of the plates 114 may weigh approximately 10 pounds (lbs.). In another example, each of the plates 114 may weigh approximately 5 lbs. In another embodiment, some of the plates 114 may be one weight (e.g., 5 lbs.) while others have a different weight (e.g., 10 lbs.).

In the embodiment shown in FIG. 1, the cable and pulley system 106 includes a first cable 116 having a handle 118 or other structure attached to one end thereof. The first cable 116 extends through a first pulley 120A and is coupled with a fixed structure 122 associated with the frame 102. The first pulley 120A is coupled with a linear bearing structure 124 positioned on a guide member 126 that is coupled to the frame 102. A second cable 126 has a first end that is coupled with the linear bearing structure 124, extends through additional pulleys 120B and 120C, and has a second end coupled with the resistance selector 110. In the embodiment depicted in FIG. 1, the resistance selector 110 is disposed, at least partially, within an open channel formed by the alignment of individual apertures of each weight plate 114 as shall be described in further detail below.

The weight plates 114 are each slidably coupled with one or more guide members 130, such as guide rods, that are coupled with the frame 104. As will be apparent upon further reading of the description of operation of the resistance selector 110, when the resistance selector 110 is engaged with one or more weight plates 114 of the weight stack 112, the resistance selector 110 and the engaged weight plates 114 will be displaced along the path defined by the guide members 130 concurrently with the displacement of any engaged weight plates 114 along the path defined by their associated guide members 130.

It is noted that, in the various example embodiments, two guide members 130 are shown and described as being associated with the weight stack 112. However, a single guide member 130, or a plurality of guide members 130 greater than two, may be associated with the weight stack 112 in other embodiments of the present invention.

During use of the apparatus 100, a user pulls on the handle 118 to actuate the cable and pulley system 106. When the handle 118 is displaced sufficiently downwardly or laterally away from the frame 104 (or both downwardly and laterally away from the frame 104), the first cable 118 causes the linear bearing structure 124 to be downwardly displaced along its associated guide member 126. This in turn causes the second cable 128 to be displaced causing the resistance selector 110, with which it is coupled, and any weight plates 114 of the weight stack 112 that are engaged by the resistance selector 110, to be displaced upwardly along their associated guide members 130.

It is noted that the apparatus 100 described with respect to FIG. 1 is merely an example and that the present invention may be used in conjunction with a variety of configurations, regardless of the number of pulleys and cables or the specific arrangement of the various components. Additionally, rather than a handle 118, a connecting structure may be coupled to the first cable 118 such that the first cable may be coupled with an actuation device. As such, and as will be appreciated by those of skill in the art, the apparatus 100 described with respect to FIG. 1 should not be considered limiting to the practice of the presently disclosed invention.

Figure 2:
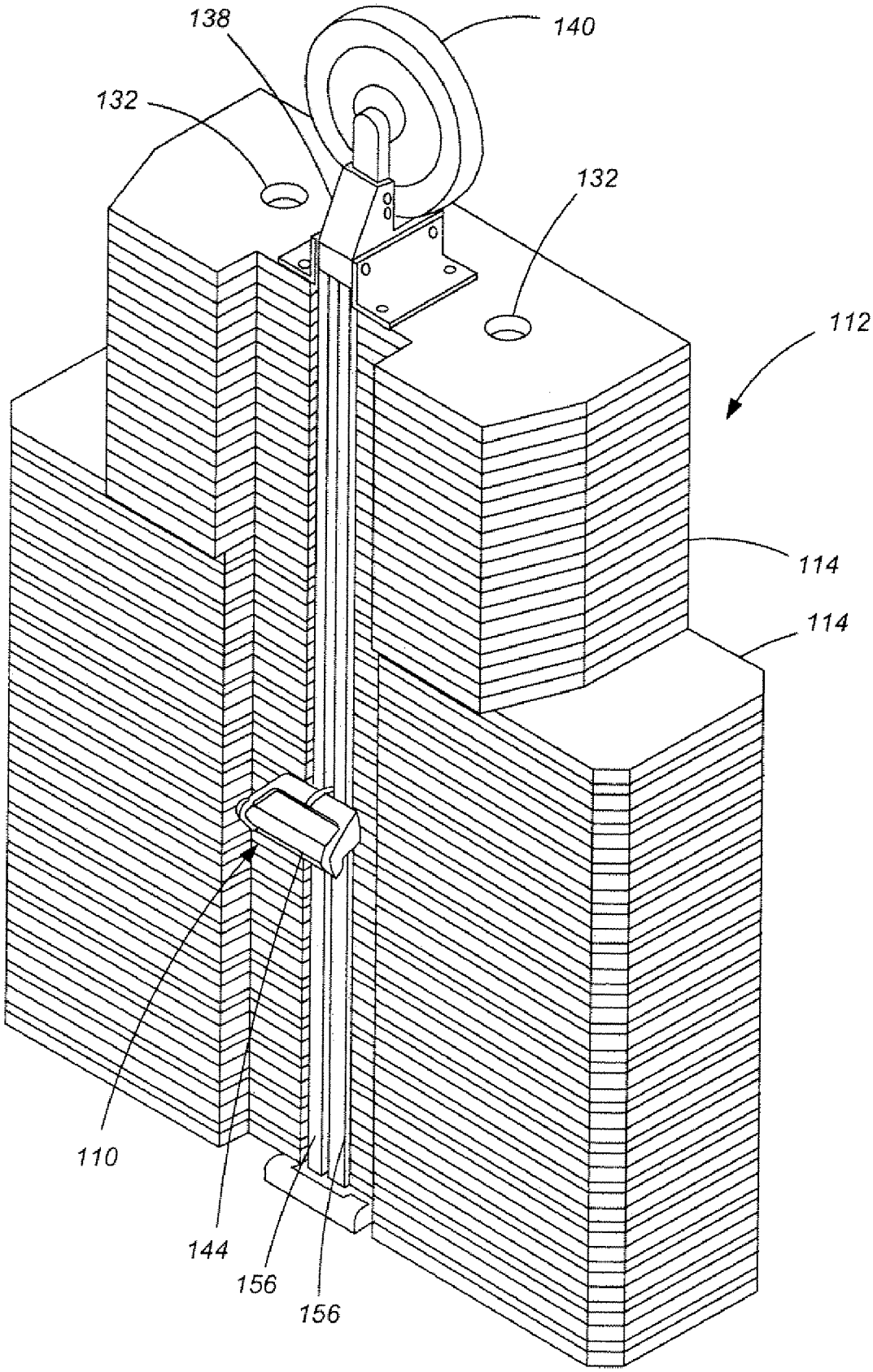
FIG. 2 is a perspective view of a weight stack and resistance selector according to an embodiment of the present invention.
Figure 3A:
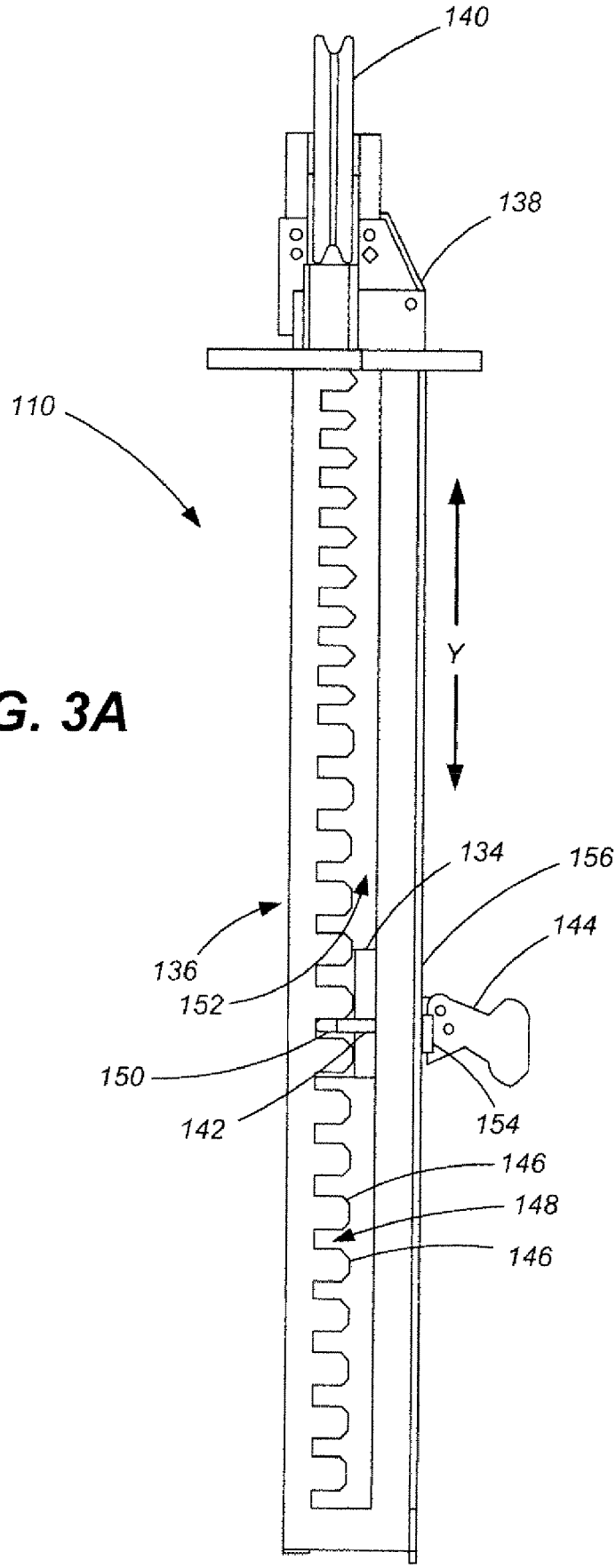
FIGS. 3A and 3B are elevational side views of a portion of a resistance selector in accordance with various embodiments of the present invention with resistance selector in engaged, and disengaged states, respectively.
Figure 3B:
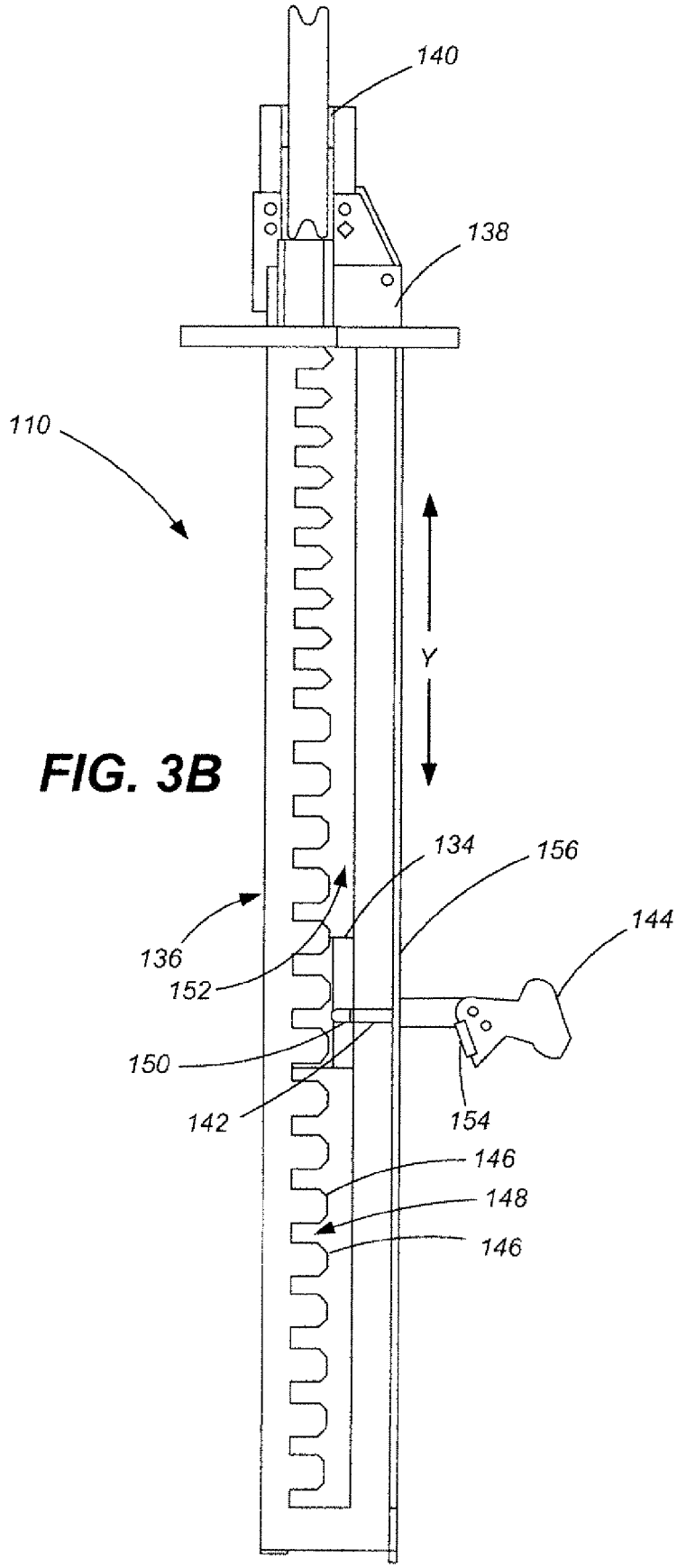
Figure 4A:
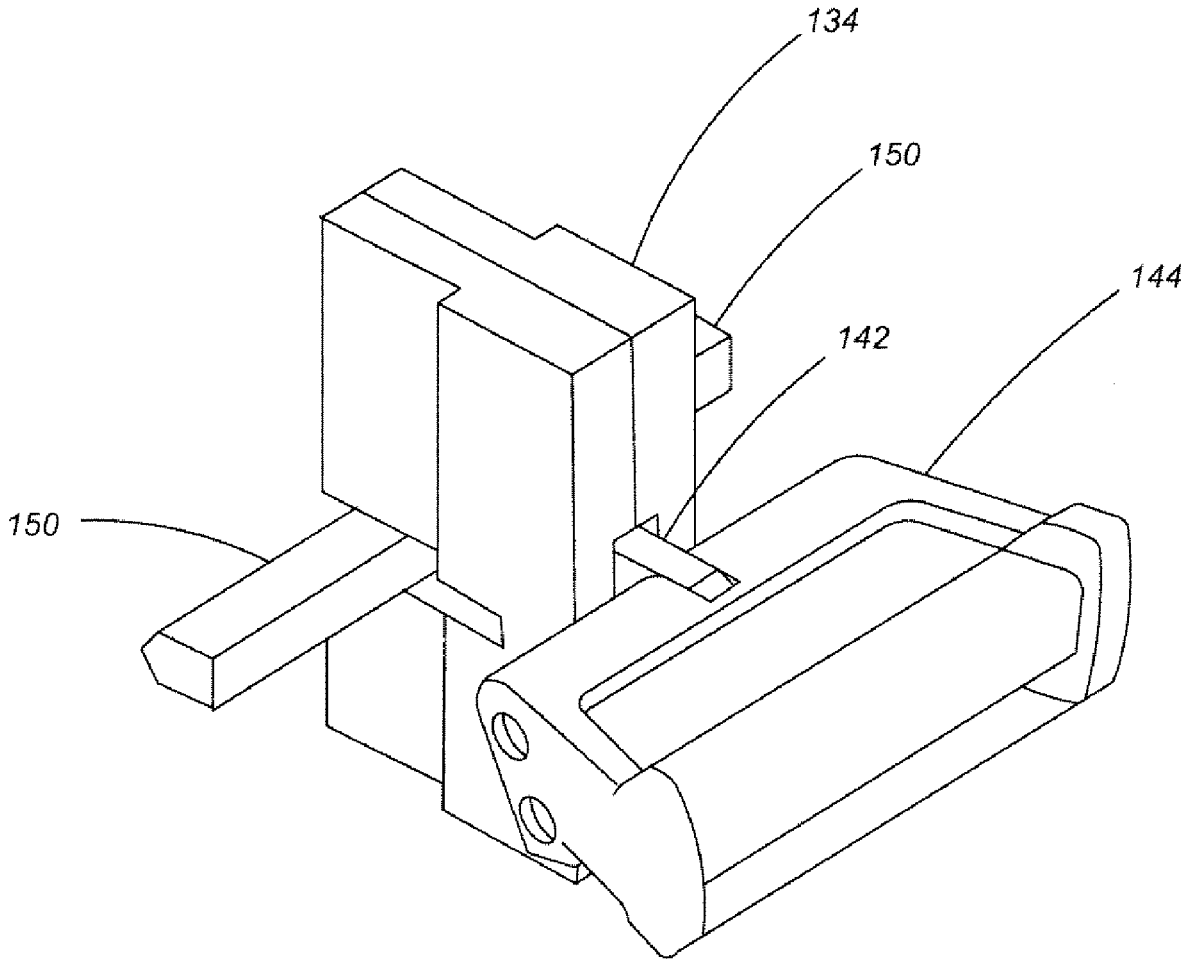
FIGS. 4A and 4B are perspective views of a portion of a resistance selector in accordance with an embodiment of the present invention wherein the selector is in an engaged state and a disengaged state, respectively.
Figure 4B:
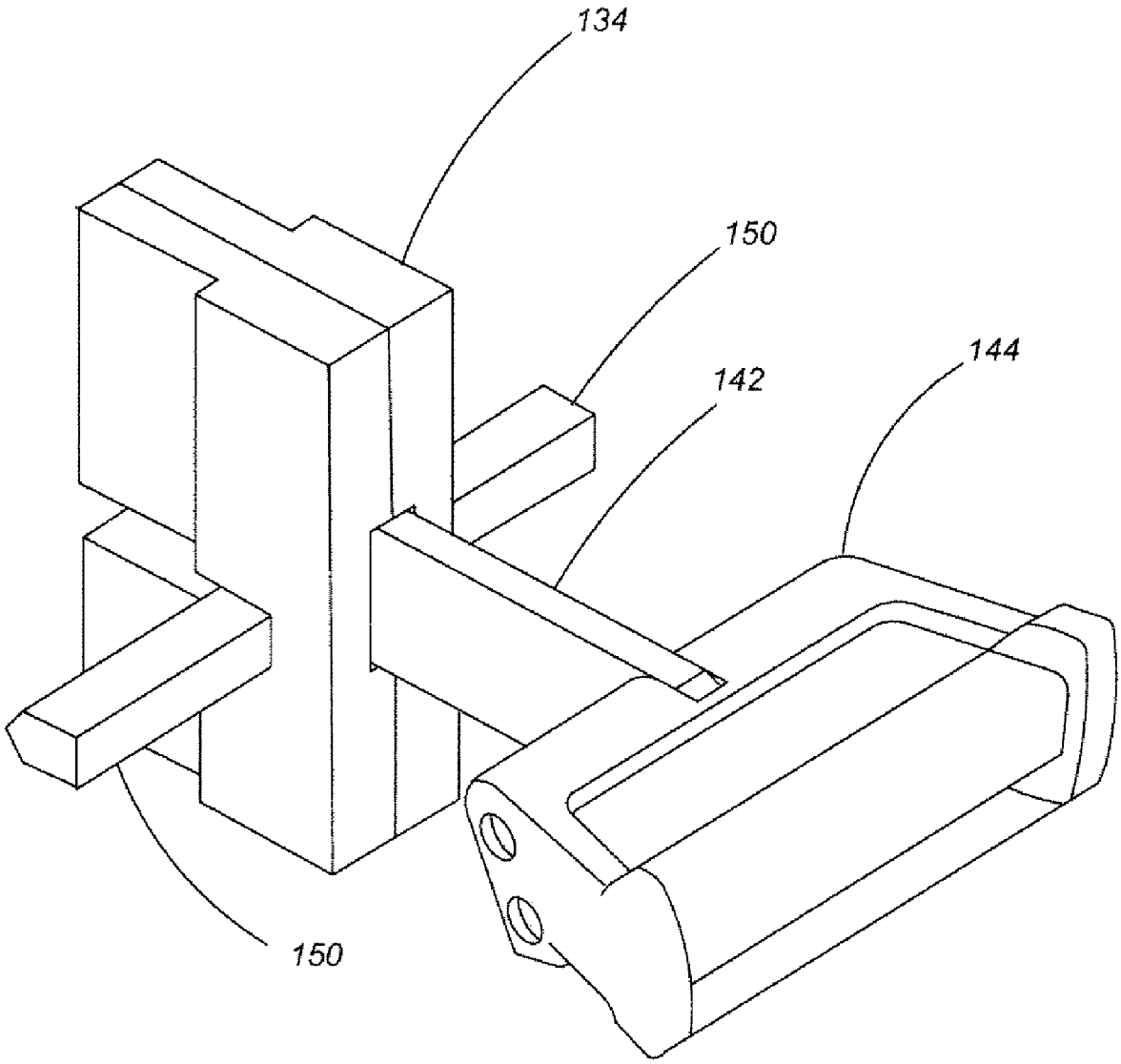

Referring to FIGS. 2, 3A, 3B, 4A and 4B, a resistance selector 110 is shown in greater detail. FIG. 2 shows a perspective view the of the resistance selector 110 in relationship to a weight stack 112. FIGS. 3A and 3B show a side view of the resistance selector in two different states of operation. FIGS. 4A and 4B are enlarged perspective views of certain components of the resistance selector 110 in different states. As previously noted, the weight stack 112 may include a plurality of discrete plates 114 that are slidably coupled to guide members 130. For example, two guide members 130 (FIG. 1) may each extend through corresponding openings 132 in the weight plates 114. In this manner, the guide members 130 act as linear bearings for the displacement of the weight plates 114.

The resistance selector 110 may include a body portion 134 configured to slide or be displaced relative to one or more rails 136. In one particular embodiment, a pair of rails 136 may be configured to define a longitudinal extending channel. The body portion 134 may be positioned between the rails 136 and configured to slide within the longitudinal extending channel. A bracket 138, bracket assembly or other structure may be coupled to the rails 136 and may also be coupled to the uppermost weight plate 114 of the stack of weight plates 114. In one embodiment, a pulley 140 may be rotationally coupled to the bracket 138 and configured to engage a cable of the cable and pulley system 106 such that, when the cable and pulley system 106 is actuated, the resistance selector 110 (and any weight plate engaged thereby) is displaced by such actuation.

A pin 142 or other structure may be slidably coupled with the body portion 134. For example, in one embodiment, the pin 142 may slide relative to the body 134 in a direction that is substantially transverse to the direction which the body 134 slides relative to the rail or rails 136. In other embodiments the pin 142 may slide relative to the body 134 at other angles relative to the sliding direction of the body 134.

A handle 144 may be coupled with the pin 142 to accommodate selective displacement of the pin 142 by a user of the exercise apparatus 100. For example, a user may apply a force to the handle 144 to effect displacement of the pin 142 from a first position, which may be referred to as an engaged position or state (see FIGS. 3A and 4A), to a second position, which may be referred to as an retracted or disengaged position or state (see FIGS. 3B and 4B).

The rails 136 of the resistance selector 110 may each include a plurality of teeth 146 which define or otherwise help to provide a plurality of notches 148 therebetween. When more than one rail 136 is used, the rails 136 are positioned to align corresponding notches 148 with one another. When the pin 142 is in the engaged position, an engagement structure 150, which extends laterally from the pin 142, is positioned within, and generally cooperatively engages, a pair of aligned notches 148. When a user applies a force to the handle 144 to displace the pin 142 to the retracted or disengaged state, the engagement structure 150 is withdrawn from the notches 148 and is positioned in a slot 152 that extends generally along the length of the rail 136.

Thus, when the resistance selector 110 is in an engaged position or state, the engagement structure 150 is positioned within a notch of a rail 136 (or a corresponding pair of notches of the rails 136 when multiple rails 136 are utilized) such that the engagement structure 150 abuts a surface of one or both of the teeth 146 helping to define the notch 148. Thus, the abutment of the engagement structure 150 with the teeth 146 prevent the body 134 from being displaced in a direction "Y" generally along the length of the slots 152. However, when the resistance selector 110 is in a disengaged position or state, the engagement structure 150 no longer abuts any of the teeth 146 and is position within the slot 152 (or corresponding slots) such that the body 134 is free to be displaced in the Y direction.

The resistance selector 110 may also include a biasing structure or mechanism to maintain the pin 142 (and, thus, the engagement structure 150) in a desired position relative to the body 134. For example, in one embodiment, one or more magnets 154 may be formed in, or otherwise associated with, the handle 144. A face structure 156 or surface may be coupled to, or integrally formed with, the rails 136, wherein the face structure 156 is formed of a ferrous material such that the magnets 154 are attracted to the face structure 156. Thus, the handle 144 may be continually biased toward the face structure 156, maintaining the pin 142 and engagement structure 150 in an engaged state unless a sufficient force is applied (such as by a user) to overcome the magnetic attraction between the magnets and the face structure. In such an embodiment, the resistance selector 110 will be biased to an engaged state requiring user action to disengage the resistance selector 110 from the weight stack 112. As will be appreciated by those of ordinary skill in the art, in another embodiment the face structure 156 may be formed of one or more magnets and the handle 144 may include a ferrous material.

In another embodiment, a different biasing member or mechanism may be utilized. For example, a spring mechanism (not shown) may be used to bias the pin 142 and engagement structure 150 to desired position requiring application of a specified force to the pin 142 (such as by way of the handle 144) to displace the pin 142 relative to the body 134.

Figure 5:
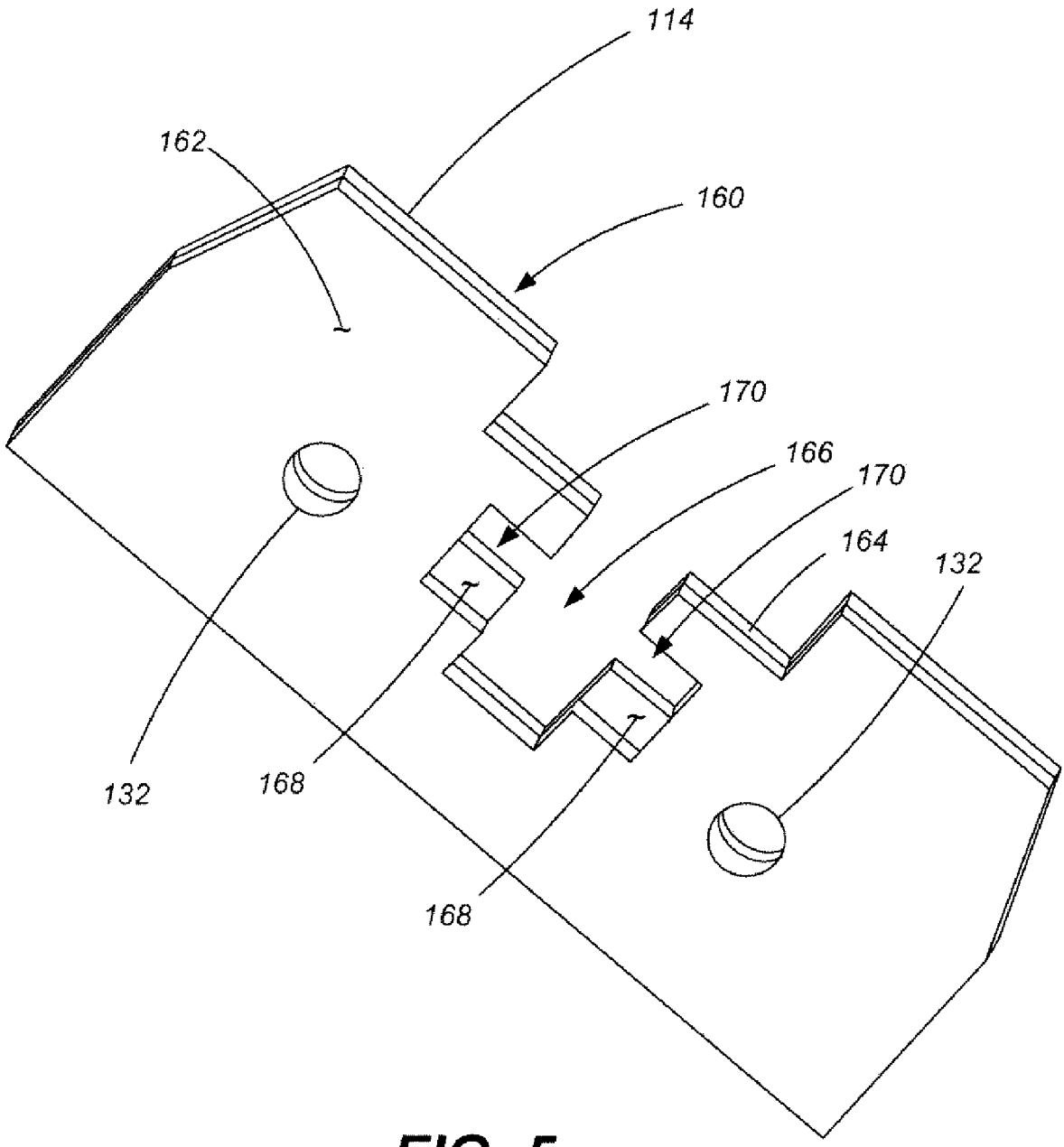
FIG. 5 is a perspective view of a weight plate used with a resistance selector in accordance with an embodiment of the present invention.

Referring now to FIG. 5, a weight plate 114 is shown according to one embodiment of the present invention. The weight plates 114 are configured to be selectively engaged and disengaged by the resistance selector 110 and, more particularly, by the engagement structure 150. The weight plates 114 may include a first surface 160, a second opposing surface 162 and a peripheral surface 164 or edge. The peripheral surface 164 includes a portion that is generally concave, defining an opening 166, and which may exhibit a peripheral geometry that substantially mates with a cross sectional geometry of the resistance selector 110 taken in a direction substantially transverse to the Y direction and including the body portion 134, rails 136, pin 142 and engagement structure 150. Thus, in the presently described embodiment, a peripheral geometry of the opening 166 is substantially T-shaped.

When a plurality of weight plates 114 are stacked upon one another to form a stack 112 (see, e.g., FIG. 2), the T-shaped openings 166 are aligned such that they define a channel that exhibits a substantially T-shaped cross-sectional geometry. The T-shaped channel is configured to receive the resistance selector 110 and to enable sliding or displacement of the body 134 (and associated pin 142, pin 144 and engagement structure 150) relative to the rails 136 and weight stack 112 when the resistance selector is in a disengaged state.

Still referring to FIG. 5, the weight plate also includes an abutment shoulder 168 formed in the lateral portions 170 of the T-shaped opening 166. In other words, the abutment shoulder 168 of weight plate 114 includes a surface disposed within the T-shaped peripheral opening that is not coplanar with the first and second surfaces 160 and 162 but, rather, lies between such surfaces. The abutment shoulders 168 provide a surface with which the engagement structure 150 (FIGS.

3A, 3B, 4A and 4B) may abut when in the engaged state or position. Such a structure may be made, for example by casting the weight plate 114 with a recessed abutment shoulder 168, by machining the abutment shoulder 168 from a mass of material, or by coupling together two separate bodies or weight plates with the two bodies having slightly different geometries for the T-shaped opening 166.

Figure 6A:
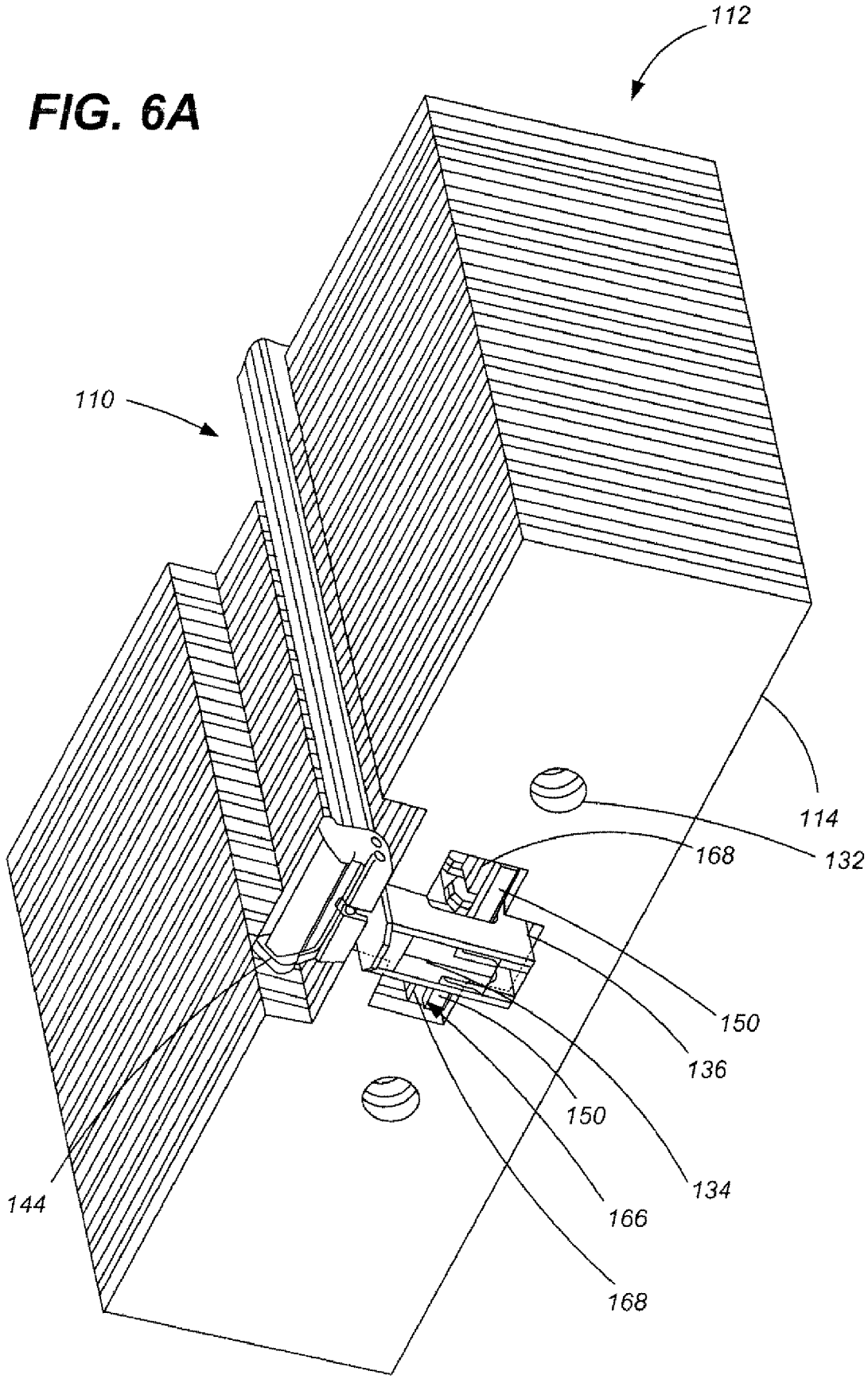
FIGS. 6A and 6B are perspective views of a resistance selector and weight stack, from beneath, in engaged and disengaged states, respectively, in accordance with an embodiment of the present invention.
Figure 6B:
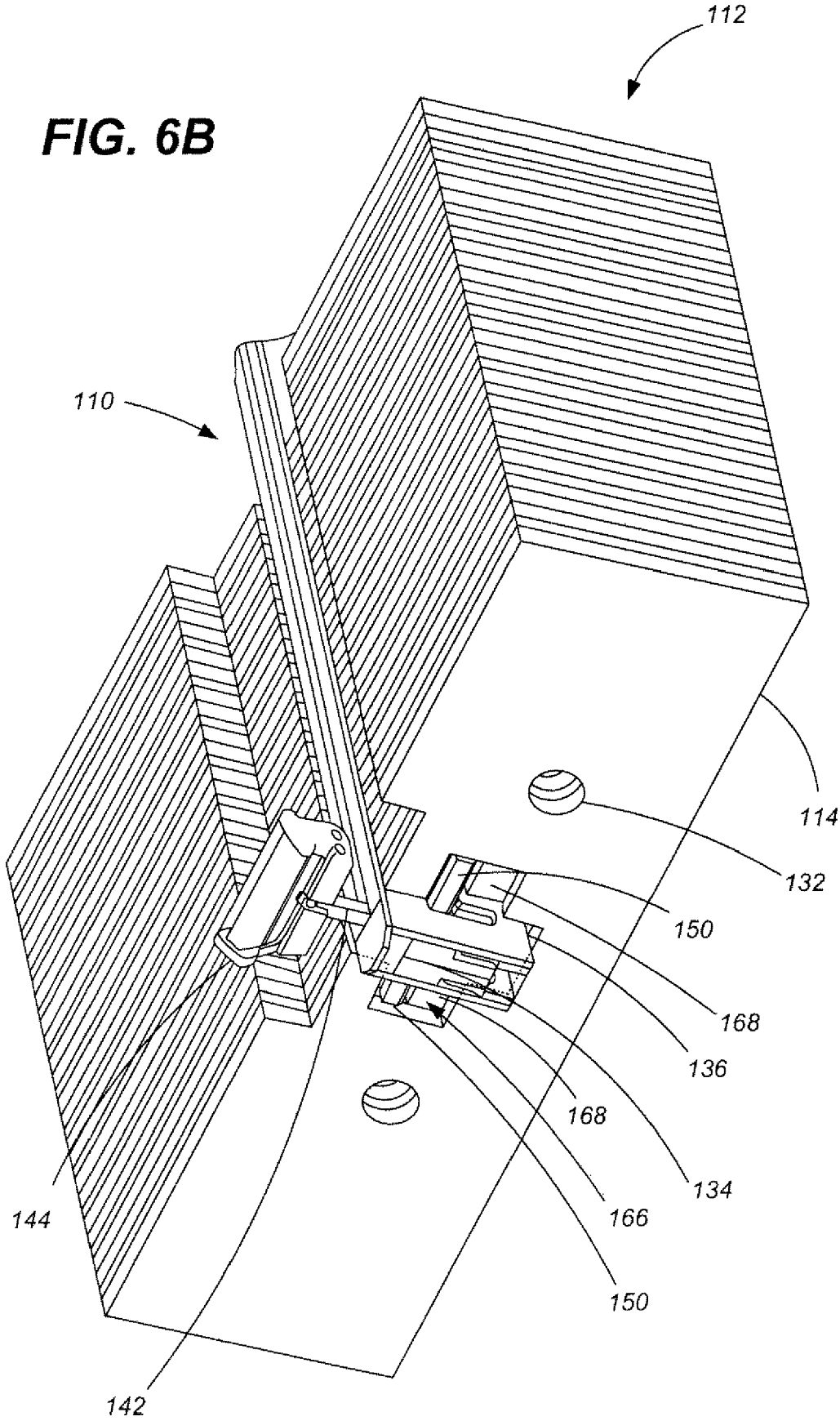

Thus, referring specifically to FIGS. 6A and 6B while maintaining general reference to all the drawing figures, when the resistance selector 110 is in an engaged position (i.e., FIGS. 3A, 4A and 6A), the engagement structure is positioned within a notch 148 such that, if displaced upwards in the Y direction, it will contact an adjacent tooth 146, as has been described above. Additionally, the engagement structure 150 will contact the abutment shoulders 168 of the weight plate 114 adjacent the notch 148 in which the engagement structure 150 such as may be seen in FIG. 6A.

With the engagement structure 150 in abutting engagement with the teeth 146 of the rails 136 and the abutment shoulders 168 of a selected weight plate 114, when the cable and pulley system 116 is actuated, the resistance selector 110 will be displaced upwards (based on the orientation shown in FIG. 1) causing the weight plate 114 that is abutted by the engagement structure 150, and any weight plates 114 disposed thereabove, to be displaced in a like manner.

When the resistance selector 110 is in a disengaged position or state, the engagement structure 150 is withdrawn from the abutment shoulders 168 and the notches 148 such that the body 134 (and associated pin 142, handle 144 and engagement structure 150) may slide within the slots 152 and be displaced in the Y direction and so that a newly selected weight plate 114 may be engaged by the engagement structure 150 of the resistance selector 110. It is noted that the open sections of the lateral portions 170 of the T-shaped opening 166 (i.e., the sections in the lateral portions 170 adjacent the abutment shoulders 168) align with the slots 152 formed in the rails 136 so as to define channels through which the engagement structure 150 may be selectively displaced such as has been described above.

Thus, the described embodiments of the invention provide an efficient means of selecting a desired amount of resistance in an exercise apparatus. Additionally, the described embodiments provide a resistance selection mechanism that does not allow a selector key or pin to be removed from the exercise apparatus (and, thus, become lost or used with an incompatible apparatus) or become damaged or the potential for injury to a user due to misuse or partial engagement.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. An exercise apparatus comprising:

a frame;

at least one guide member coupled with a portion of the frame;

a weight stack including a plurality of weight plates associated with the at least one guide member;

a resistance selector comprising:

at least one rail coupled to an uppermost weight plate of the plurality of weight plates, a body slidably coupled to, and displaceable along a length of, the at least one rail, a pin slidably coupled to the body and configured to be displaced between at least a first position and a second position relative to the body, and an engagement structure directly coupled with the pin and extending laterally from the pin to selectively engage at least one abutment shoulder of at least one weight plate of the plurality of weight plates.

2. The exercise apparatus of claim 1, wherein the at least one rail includes a plurality of teeth and a plurality of notches.

3. The exercise apparatus of claim 2, wherein the at least one rail includes a slot adjacent the plurality of teeth and plurality of notches.

4. The exercise apparatus of claim 3, wherein, when the pin is in the first position, the engagement structure is disposed within a notch of the plurality of notches and is positioned adjacent the at least one abutment shoulder.

5. The exercise apparatus of claim 4, wherein, when the pin is in the second position, the engagement structure is positioned within the slot.

6. The exercise apparatus of claim 1, wherein each weight plate of the plurality of weight plates includes a first surface, a second, opposing surface and a peripheral surface, the peripheral surface defining, at least in part, an opening sized and configured to receive at least a portion of the resistance selector.

7. The exercise apparatus of claim 6, wherein the at least one abutment shoulder of at least one weight plate includes a surface that is not coplanar with either the first surface or the second, opposing surface.

8. The exercise apparatus of claim 1, wherein the at least one guide member includes two guide members laterally spaced from one another and extending parallel to one another.

9. The exercise apparatus of claim 8, wherein the two guide members extend through apertures formed in each of the plurality of weight plates.

10. The exercise apparatus of claim 1, wherein the body is slidable in a first direction relative to the at least one rail, and wherein the pin is slidable relative to the body in a second direction that is substantially transverse to the first direction.

11. The exercise apparatus of claim 1, further comprising at least one pulley coupled with the frame and at least one cable engaging at least a portion of the at least one pulley and being coupled with the resistance selector.

12. An exercise apparatus comprising:

a frame;

at least one guide member coupled with a portion of the frame;

a weight stack including a plurality of weight plates associated with the at least one guide member;

a resistance selector comprising:

at least one rail comprising a plurality of teeth and a plurality of notches and a slot adjacent the plurality of teeth and plurality of notches, the at least one rail being coupled to an uppermost weight plate of the plurality of weight plates, a body slidably coupled to the at least one rail, a pin slidably coupled to the body and configured to be displaced between at least a first position and a second position relative to the body, an engagement structure directly coupled with the pin and configured to selectively engage at least one abutment shoulder of at least one weight plate of the plurality of weight plates, and a biasing member configured and positioned to bias the selector pin towards the first position;

wherein, when the pin is in the first position, the engagement structure is disposed within a notch of the plurality of notches and is positioned adjacent the at least one abutment shoulder, and wherein, when the pin is in the second position, the engagement structure is positioned within the slot.

13. The exercise apparatus of claim 12, wherein the biasing member includes at least one magnet.

14. The exercise apparatus of claim 12, further comprising a handle coupled with the pin.

15. An exercise apparatus comprising:

a frame;

at least one guide member coupled with a portion of the frame;

a weight stack including a plurality of weight plates associated with the at least one guide member, each weight plate of the plurality of weight plates including a first surface, a second, opposing surface and a peripheral surface;

a resistance selector comprising:

at least one rail coupled to an uppermost weight plate of the plurality of weight plates, a body slidably coupled to, and displaceable along a length of, the at least one rail, a pin slidably coupled to the body and configured to be displaced between at least a first position and a second position relative to the body, and an engagement structure directly coupled with the pin and configured extending laterally from an axis of the pin to selectively engage at least one abutment shoulder of at least one weight plate of the plurality of weight plates;

wherein the peripheral surface of each weight plate defines, at least in part, an opening sized and configured to receive at least a portion of the resistance selector, the opening of each weight plate including at least a portion that is substantially T-shaped.

16. The exercise apparatus of claim 15, wherein the at least one abutment shoulder is formed adjacent a peripheral edge of the opening of the at least one weight plate.

* * * * *